US006395224B1

(12) United States Patent
Nishino et al.

(10) Patent No.: US 6,395,224 B1
(45) Date of Patent: May 28, 2002

(54) MAGNESIUM ALLOY AND METHOD OF PRODUCING THE SAME

(75) Inventors: Naohisa Nishino; Hiroshi Kawahara; Yoshihiro Shimizu, all of Aichi (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 0 days.

(21) Appl. No.: 09/363,880

(22) Filed: Jul. 30, 1999

(30) Foreign Application Priority Data

Jul. 31, 1998 (JP) ..... 10-218114
Jun. 23, 1999 (JP) ..... 11-177276

(51) Int. Cl.[7] ..... C22C 23/00

(52) U.S. Cl. ..... 420/413; 420/407; 420/409; 420/412; 420/410; 148/538; 148/666; 148/420

(58) Field of Search ..... 420/407, 409, 420/410, 412, 413; 148/420, 538, 666

(56) References Cited

FOREIGN PATENT DOCUMENTS

| | | | |
|---|---|---|---|
| JP | 2085332 | * | 3/1990 |
| JP | 9-157782 | | 6/1997 |
| JP | 2705844 | | 10/1997 |
| JP | 9279286 | * | 10/1997 |
| SU | 569638 | * | 8/1977 |

OTHER PUBLICATIONS

Nussbaum, G; Sainfort, P.; Regazzoni, G; Gjestand, H., Strengthening Mechanisms in the Rapidly Solidified AZ91 Magnesium Alloy, Sci. Matall. (1989), 23(7), 1679–84 (Abstract Only).*

Takuda, Hirohiko; Kzley Chi, Shiomi; Halta, Natsuo, Possibility of Grain Refinement for Superplasticity of a Magnesium–Aluminum–Zinc Alloy by Pre–Deformation, J. Mates. Sci. (1992), 27(4), 937–40.*

* cited by examiner

*Primary Examiner*—Sikyin Ip
(74) *Attorney, Agent, or Firm*—Oblon, Spivak, McClelland, Maier & Neustadt, P.C.

(57) ABSTRACT

A magnesium alloy of the present invention includes magnesium as a main component, boron of 0.0005 weight % or more, manganese of 0.03 to 1 weight %, and substantially no zirconium or titanium. This magnesium alloy may further include aluminum of 1 to 30 weight % and/or zinc of 0.1 to 20 weight %. Because of appropriate amounts of boron and manganese contained in the magnesium alloy, the grain of the mangnesium alloy is refined.

18 Claims, 5 Drawing Sheets

100 μm

Microstructure of as-cast AZ91 alloy with B addtion

100 μm

Microstructure of as-cast AZ91 alloy with B addtion

100 μm

Microstructure of as-cast AZ91 alloy without B addtion

100 μm

Microstructure of T4 treated (415℃, 24h) AZ91 alloy with B addition

100 μm

Microstructure of T4 treated (415℃, 24h) AZ91 alloy without B addition

Microstructure of T4 treated (415℃, 24h) AZ91 alloy with B addition after held quietly in a molten state for 30 minutes Microstructure of T4 treated (415℃, 24h) AZ91 alloy with B addition after remelted Microstructure of T4 treated (415℃, 24h) AZ91 alloy with 0.05% B addition Microstructure of T4 treated (415℃, 24h) AZ91 alloy with 0.1% B addition Microstructure of T4 treated (415℃, 24h) AZ91 alloy with 0.2% B addition 100 μm No refining effect
Mg−9%Al−1%Zn−0.5%Mn−0.38%B alloy
(Compound in Al−4%B alloy: α−$AlB_{12}$)

100 μm

Good refining effect
Mg−9%Al−1%Zn−0.5%Mn−0.38%B alloy
(Compound in Al−4%B alloy:
β−$AlB_{12}$+$AlB_2$)

MAGNESIUM ALLOY AND METHOD OF PRODUCING THE SAME

BACKGROUND OF THE INVENTION

1. Field of the Invention

This invention relates to a magnesium alloy, and more particularly to a magnesium alloy having fine grain structure and a method of producing the same.

2. Description of the Related Art

Grain refinement of a magnesium alloy is extremely effective in improving mechanical properties of the magnesium alloy. A variety of attempts have been made and the following three methods have been put into practical use.

(1) The Method of Adding Zirconium to a Magnesium Alloy

This method is effective in refining grain, and magnesium alloys containing zirconium are standardized, for example, in the ASTM.

(2) The Method of Adding $C_2Cl_4$ (tetrachloroethylene), $C_2Cl_6$ (hexachloroethane) or the Like to a Magnesium-aluminum Alloy It is supposed that $Al_4C_3$ is formed by adding these carbon-containing compounds, and that the grain refinement of the magnesium alloy is realized by this aluminum carbide.

(3) The Method of Superheating a Molten Magnesium Alloy Just Before Pouring it Into a Mold.

It is assumed that in this method of superheating, rapid cooling and pouring a molten magnesium alloy in a mold, grain is refined by the effect of the iron and/or carbon which have dissolved from a crucible or the like into a molten magnesium alloy These methods can attain the grain refinement of a magnesium alloy. However, there remain following problems.

The method (1) is highly effective in grain refining of a magnesium alloy, but is available only for alloys not containing aluminum. When zirconium is added to an alloy containing aluminum, its refining effect disappears. This is because zirconium reacts with aluminum to form a compound. The zirconium-aluminum compound does not have an effect of refining the grain of the magnesium alloy. In addition, zirconium is often added into a molten magnesium alloy, using a mgnesium-zirconium mother alloy. This mother alloy is prepared from magnesium ingots and zirconium chloride based flux. In this case, harmful chloride gas generates during the addition process. Also the chloride remaining in the magnesium alloy causes corrosion of the magnesium alloy. In addition, when the molten magnesium alloy is held quietly in order to remove impurities, zirconium also settles (or precipitates) and is removed from the magnesium alloy. As a result, its refining effect disappears.

The method (2) of adding tetrachloroethylene, hexachloroethane, or the like has a similar chloride gas problem to that of the method (1) of adding zirconium. That is to say, harmful chloride gas generates and the chloride remaining in the magnesium alloy causes corrosion. In addition to this, when the molten magnesium alloy is held quietly in order to remove impurities, carbon volatilizes from the magnesium alloy and the refining effect decreases.

In the method (3) of superheating, rapid cooling and pouring a molten magnesium alloy into a mold, there is a need to superheat a molten magnesium alloy to approximately 900° C. and then take out a crucible from a melting furnace and rapidly cool the molten alloy to around a temperature at which the molten alloy is suitable to be poured into a mold. Thus, the casting procedure becomes very complicated. In addition, the grain is not refined when the cooling rate of the molten alloy is not high enough. Also, unless the molten alloy is poured into a mold immediately after being rapidly cooled, the grain is not refined. Also, the obtained magnesium alloy deteriorates in corrosion resistance because the iron content in the obtained magnesium alloy increases.

Further, Japanese Unexamined Patent Publication (KOKAI) No. H9-157782 and Japanese Patent Registration No.2705844 disclose magnesium alloys containing 0.001 to 0.02 weight % boron.

The magnesium alloy disclosed in the former publication contains 0.5 to 2 weight % zirconium. Accordingly, there still exist the above-described problems such as chloride gas generation, corrosion caused by chlorides, grain refining effect disappearance caused by holding the molten magnesium alloy, and the former publication discloses no solution for these problems. Besides, because zirconium reacts with aluminum to form a compound, zirconium does not contribute to grain refinement of widely used magnesium-aluminum alloys.

On the other hand, the magnesium alloy disclosed in the latter publication contains 0.005 to 0.1 weight % titanium. The present inventors' examinations and researches demonstrate that titanium does not refine the grain of magnesium alloys. When titanium and boron are contained simultaneously in magnesium alloys, an adverse effect of increasing the grain size of the magnesium alloys was observed.

SUMMARY OF THE INVENTION

The present invention has been conceived in view of the above problems. It is an object of the present invention to provide a magnesium alloy which can have fine grain easily under ordinary casting conditions, and which can maintain fine grain even when the molten alloy is held at high temperatures for a long time with the purpose of removing impurities and inclusions or waiting until casting is carried out, or even after the solidified alloy is melted again.

In order to achieve this object, the present inventors have conducted intensive researches and various systematic experiments. As a result, the present inventors have found and confirmed that the grain of a magnesium alloy can be refined by including boron and manganese at the same time.

The present inventors have also established a method of producing a magnesium alloy having fine grain by cooling and solidifying a molten magnesium alloy which has been prepared to include boron and manganese.

(Magnesium Alloy)

The magnesium alloy according to the present invention comprises magnesium as a main component, boron of 0.0005 weight % or more, manganese of 0.03 to 1 weight %, and substantially no zirconium and no titanium.

Boron is highly effective in refining grain of magnesium alloys. The boron of 0.0005 weight % or more is necessary for grain refinement because when the boron content is less than 0.0005%, almost no grain refining effect is obtained.

In order to obtain a sufficient grain refining effect, it is suitable to set the boron content to be 0.001 weight % or more.

On the other hand, an increase in the boron content does not cause any problem in refining grain. However, excessive boron settles (precipitates) as a compound, and boron sediment (or precipitation) does not contribute to grain refinement. Also, an increase in the boron content is disadvantageous in terms of production costs. The present inventors have confirmed that the effect of grain refinement almost reaches the maximum when the boron nominal content is approximately 0.5%. Accordingly, it is preferable to set the boron content to be 0.5% or less.

Therefore, it is more preferable that the boron content is in a range from 0.001 to 0.5 weight %.

Manganese is an element which is necessary to achieve the grain refinement of a magnesium alloy when boron is contained in the magnesium alloy simultaneously. When the manganese content is less than 0.03 weight %, almost no grain refining effect is obtained.

On the other hand, when the manganese content exceeds 1 weight %, excess manganese exists as insoluble manganese or an insoluble manganese compound, and the insoluble manganese or manganese compound absorb boron and make the grain refining effect of boron decrease or disappear. Therefore, it is preferable to set the manganese content in a range from 0.03 to 1 weight %.

In order to refine the grain of a magnesium alloy further and efficiently, it is more suitable to set the manganese content in a range from0.05 to 0.8 weight %.

The details of the mechanism as to how grain is refined have not been clarified yet, but it is supposed that the grain refining effect largely attributes to a multiplier effect of boron and manganese. This will be discussed later.

Zirconium unfavorably reacts with aluminum to form a compound, so zirconium has no grain refining effect in a magnesium alloy including aluminum. Besides, zirconium is often added in a molten magnesium alloy by using chloride-based flux, so harmful chloride gas generates during the addition process. This is not desirable. Therefore, the magnesium alloy according to the present invention is set to comprise substantially no zirconium.

Coexistence of titanium and boron in a magnesium alloy is unfavorable because the grain size of the magnesium alloy tends to increase. Therefore, the magnesium alloy according to the present invention is set to comprise substantially no titanium.

The magnesium alloy according to the present invention is set to comprise "substantially" no zirconium or titanium because the magnesium alloy may contain zirconium or titanium as impurities.

The magnesium alloy according to the present invention comprises magnesium as a main component, and may include additional elements other than boron, manganese, zirconium and titanium. For example, in order to attain a variety of objects, the magnesium alloy of the present invention may contain aluminum as one of the principal alloying elements of magnesium alloys, zinc, calcium, rare earth elements and silver. Of course, the magnesium alloy of the present invention can contain inevitable impurities such as iron.

As described above, owing to the fine grain, the magnesium alloy of the present invention is greatly improved in mechanical properties such as strength and toughness.

Now, some additional discussion will be made as to fine grain.

The grain size is influenced by the cooling rate during solidification besides the addition of a grain refiner. For instance, when the cooling rate is high, the grain size is small. In general, as the grain size is smaller, mechanical properties such as tensile strength, elongation and impact value are higher. Therefore, in the case of thick castings, the grain size becomes larger and the mechanical properties become lower as the distance from the surface becomes larger. When grain refining treatment is applied to such castings, although the castings may not have a uniform grain size, the grain size of each part becomes smaller than before the grain refining treatment is applied. Therefore, since an improvement in mechanical properties of the castings can be expected, the present invention has a high industrial value. To be concrete, when the grain diameter is decreased by about 25%, the mechanical properties are greatly improved even after data scatter is taken into consideration. Therefore, though the grain size is not limited in the present invention, whether the grain refining effect is obtained or not is determined by whether the grain diameter is decreased by 25% or more based on the grain diameter of a magnesium alloy to which no grain refining treatment is applied.

It is particularly preferable that a magnesium alloy has a grain diameter of 100 $\mu$m or less, because magnesium alloys can have higher absolute values in respect of mechanical properties, for example, an AZ91 alloy can have a tensile strength of about 300 MPa.

In addition, the magnesium alloy according to the present invention has fine grain even after the alloy is held in molten state for a long time, moreover, even after the alloy is melted again.

(Method of Producing a Magnesium Alloy)

Next, in producing the magnesium alloy according to the present invention, it is suitable to employ a method of producing a magnesium alloy having fine grain, comprising:

the molten metal preparation step of having a molten magnesium alloy contain boron and manganese by employing a grain refiner which includes at least one of metallic boron, a boron-containing compound and a boron-containing alloy, and at least one of metallic manganese, a manganese-containing compound and a manganese-containing alloy, independently to each other or as a composite; and the cooling and solidifying step of solidifying molten metal obtained in the molten metal preparation step.

It is very suitable to employ this method of producing a magnesium alloy because a magnesium alloy having fine grain can be obtained easily without complicated melting and casting processes.

The molten metal preparation step is necessary to have a magnesium alloy contain boron and manganese. These boron and manganese are made to be contained in a molten magnesium alloy by a grain refiner.

In the molten metal preparation step, for example, a grain refiner which includes boron and manganese can be added to a molten magnesium alloy, or a raw material including a magnesium alloy and the mentioned grain refiner can be heated to be melted. There is no need to mix or add boron and manganese simultaneously. For example, it is possible to add metallic boron, a boron compound or the like into a molten magnesium alloy which contains manganese beforehand and vice-versa. A molten magnesium alloy containing boron and manganese should be prepared during the molten metal preparation step.

Next, the cooling and solidifying step is necessary to obtain a magnesium alloy having fine grain of the present invention from the molten magnesium alloy obtained in the molten metal preparation step. In this cooling and solidifying step, it is possible to employ, for example, die casting, low pressure casting, gravity casting, unidirectional solidification processing, continuous casting, and pressure casting. Any suitable casting process can be employed in accordance with purposes. The production method according to the present invention is excellent as a method of producing a magnesium alloy having fine grain.

Now, the mechanism as to how the grain of a magnesium alloy is refined by boron and manganese will be discussed in detail, employing the production method according to the present invention as an example. As described before, this mechanism is not fully clarified yet, but it is supposed as follows.

When boron is contained in a molten magnesium alloy, although most boron settles (or precipitates) in the bottom of the crucible, about 0.01 weight % of boron dissolves into the molten alloy.

About 1 weight % of manganese dissolves into a molten magnesium alloy. Manganese over about 1 weight % exists as insoluble manganese or an aluminum-manganese compound. Part of these are suspended in the molten magnesium alloy and the remainder settles (or precipitates) in the bottom of the crucible.

It is supposed that part of boron and manganese added into a molten magnesium alloy form a boron-manganese compound before magnesium crystallizes in the solidifying step.

On the other hand, it is assumed that part of manganese in a molten magnesium alloy forms a cluster together with aluminum, iron, carbon, etc. This is because manganese has a high affinity for aluminum, iron, carbon, etc. However, when boron is added to a molten magnesium alloy, the cluster is changed and/or a new cluster is formed from which part of manganese and iron are removed.

It is supposed that the boron-manganese compound thus formed and/or the newly formed cluster become nucleus, thereby attaining grain refinement.

Now, the boron content and the manganese content will be discussed again in view of the foregoing discussion.

In the magnesium alloy according to the present invention, the manganese content is set to be 0.03 to 1 weight %, because the manganese content of less than 0.03 weight % is not sufficient to form the aforementioned boron-manganese compound or cluster. On the other hand, when the manganese content exceeds 1 weight %, manganese which cannot dissolve into the molten alloy exists as insoluble manganese or a manganese compound. This insoluble manganese absorbs much boron and settles (or precipitates) in the bottom of the crucible. As a result, the boron content is insufficient to refine the grain of the magnesium alloy, and the compound or cluster as a nucleus is not formed sufficiently. Therefore, the grain refining effect is weaken or not appear.

The boron content is set to be 0.0005 weight % or more because the boron content of less than 0.0005 weight % is not sufficient to form the aforementioned compound or cluster. Therefore, when the boron content is less than 0.0005 weight %, the grain refining effect is weaken or not appear.

The magnesium alloy having fine grain according to the present invention comprises magnesium as a main component, boron of 0. 0005 weight % or more, manganese of 0.03 to 1 weight %, and substantially no zirconium and no titanium. It is more preferable that the magnesium alloy of the present invention includes aluminum of 1 weight % or more.

Aluminum is an element which is effective in improving mechanical properties of magnesium alloys. When aluminum is contained in a magnesium alloy, grain refinement of the magnesium alloy is further promoted and mechanical properties of the magnesium alloy is further improved.

Particularly when aluminum is contained at 5 weight % or more, the effect of refining the grain of magnesium alloys is remarkable.

It is also preferable that the aluminum content is set to be 30 weight % or less in view of mechanical properties, specific gravity and castability.

It is also possible that the magnesium alloy according to the present invention includes zinc of 0.1 to 20 weight % in order to improve mechanical properties and castability of the magnesium alloy.

It is also preferable that the magnesium alloy according to the present invention includes a rare earth element (e.g., mischmetal) of 0.5 to 20 weight % in view of mechanical properties, heat resistance and corrosion resistance.

As discussed above, the magnesium alloy having fine grain according to the present invention can be improved in mechanical properties by including aluminum, zinc or a rare earth element(s) in addition to boron and manganese.

The method of producing a magnesium alloy having fine grain according to the present invention comprises a molten metal preparation step and a cooling and solidifying step.

In the molten metal preparation step, boron and manganese are simultaneously contained into a molten magnesium alloy by using a grain refiner which includes boron and manganese independently to each other or as a composite. This molten metal preparation step can be carried out in various ways. For example, a grain refiner can be mixed in a molten magnesium alloy. Or, it is possible that a raw material including a magnesium alloy and a grain refiner is prepared beforehand and that this raw material is heated to be melted. In melting a magnesium alloy, a melting agent such as flux may be used.

The grain refiner includes at least one of metallic boron, a boron-containing compound and a boron-containing alloy, and/or at least one of metallic manganese, a manganese-containing compound and a manganese-containing alloy, in single or in combination thereof. Examples of the grain refiner are as follows:

① A grain refiner being a mixture of at least one of metallic boron (boron as a simple substance), a boron-containing compound, and a boron-containing alloy, and at least one of metallic manganese, a manganese-containing compound and a manganese-containing alloy;

② a grain refiner including at least one of a boron and manganese-containing compound, and a boron and manganese-containing alloy;

③ a mixture of the above ① and ①.

Followings are examples of the raw materials of the above:

(a) Examples of the boron-containing compound include aluminum boride, magnesium boride, boron oxide, borax, boron hydride, boron fluoride, boron carbide, boron nitride, boron silicide, and boron-containing flux (e.g., fluoroborates such as potassium fluoroborate, sodium fluoroborate, lithium fluoroborate).

As aluminum boride, $AlB_2$ or/and $\beta$-$AlB_{12}$ is particularly effective in refining the grain of a magnesium alloy. Besides, alloys containing $AlB_2$ are easily available and relatively inexpensive. Aluminum is generally one of the principal alloying elements of magnesium alloys. Therefore an aluminum-boron alloy containing $AlB_2$ and/or $\beta$-$AlB_{12}$ is one of the appropriate grain refiners.

$\alpha$-$AlB_{12}$ is stable in a molten magnesium alloy and the contribution of $\alpha$-$AlB_{12}$ to grain refinement of a magnesium alloy is supposed to be small. Therefore, $AlB_2$ or/and $\beta$-$AlB_{12}$ is preferable as aluminum boride. Alloys including these compounds have similar effects.

It is also effective to use $B_2O_3$ as boron oxide.

(b) Examples of the boron-containing compound include an aluminum-boron alloy, a zinc-boron alloy, and a mischmetal-boron alloy.

An aluminum-boron alloy including $AlB_2$ or/and $\beta$-$AlB_{12}$ is particularly effective in refining the grain of a magnesium alloy.

As discussed here, it is suitable to use a compound or a mother alloy containing boron as a grain refiner. It is because the yield rate of boron added with which grain refiner is relatively high compared to that added with other grain refiner. In addition, the boron content is controlled appropriately with ease, because the solubility of boron in a molten magnesium alloy is quite low.

(c) Examples of the manganese-containing compound include manganese hydroxide, manganese fluoride, manganese chloride, potassium manganate, sodium manganate, potassium permanganate, sodium permanganate, and manganese boride.

(d) Examples of the manganese-containing alloy include an aluminum-manganese alloy, a manganese-magnesium alloy, a zinc-manganese alloy, and a rare earth element-manganese alloy.

Magnesium as a raw material may be any of pure magnesium, a magnesium-aluminum alloy, a magnesium-zinc alloy and a magnesium-rare earth element alloy, etc.

In the cooling and solidifying step according to the present invention, a magnesium alloy including a grain refiner is cast into a mold or the like and the molten magnesium alloy is cooled and solidified. By carrying out this solidifying step, a magnesium alloy having fine grain can be obtained. In carrying out the cooling and solidification processing, it is possible to employ die casting, low pressure casting, gravity casting, unidirectional solidification processing, continuous casting, pressure casting or the like in accordance with the objects.

By the production method according to the present invention, a magnesium alloy having fine grain can be obtained. The magnesium alloy produced by this production method has excellent mechanical properties such as high strength and high toughness owing to its fine grain. The magnesium alloy produced by this production method can maintain the grain refining effect even after being kept in a molten state for a long time or being remelted.

Thus, by the method of producing a magnesium alloy according to the present invention, a magnesium alloy having fine grain can be obtained with ease without carrying out complicated melting and casting processes.

BRIEF DESCRIPTION OF THE DRAWINGS

The invention will now be described with reference to the accompanying drawings wherein.

DETAILED DESCRIPTION OF THE PREFERRED EMBODIMENTS

Now, the present invention will be discussed concretely.

First Preferred Embodiment

In this preferred embodiment, a magnesium alloy (A) as an example of the present invention and a magnesium alloy (B) as a comparative example were prepared. The magnesium alloy (A) was prepared by mixing boron into a AZ91 magnesium alloy according to the ASTM Standard Specification (Al: 8.1 to 9.3%, Zn: 0.40 to 1.0%, Mn: 0.13 to 0.5%), so as to have a magnesium alloy contain boron and manganese at the same time. The magnesium alloy (B) was prepared by having a AZ91 magnesium alloy contain no boron. Employed raw materials were pure magnesium, pure aluminum, pure zinc, an Al-4% B alloy and a Mg-3.5% Mn alloy.

(Molten Metal Preparation Step)

The nominal boron content of the boron-containing AZ91 alloy (A) according to the present invention was set at 0.3 weight %. The aforementioned Al-4% B alloy was used in mixing boron into the alloy, in order to have the alloy contain boron easily at a high yield. In this case, most boron was aluminum boride ($AlB_2$ or $\beta$-$AlB_{12}$).

The influence of the kind of boron compounds in the Al-4% B alloy will be discussed in detail in the fourth preferred embodiment.

The Mg-3.5% Mn alloy was added so that the AZ91 alloy (A) of the preferred embodiment containing boron and the AZ91 alloy (B) of the comparative example free from boron respectively contain manganese of 0.5 wt %.

The relation between the manganese content and the grain refinement of a magnesium alloy will be discussed in detail in the second and third preferred embodiments.

The melting of the above alloys (A) and (B) was carried out by employing crucibles made of stainless steel according to JIS SUS430 and using 1 kg of each alloy specimen. It took about 30 minutes to melt each alloy specimen. In each of the alloys (A) and (B), zinc was added at a molten alloy temperature of 750° C. in order to improve the mechanical properties of the magnesium alloys. At this time, each molten magnesium alloy was paddled. Then each molten alloy was held quietly at 750 to 770° C. for 10 minutes in order to remove sediment (or precipitation) of inclusions and iron compounds. During this time, a small amount of Ar-5% SF6 gas was continuously blown against the surface of each molten alloy in order to prevent combustion.

The composition of the obtained AZ91 alloy (A) containing boron and the AZ91 alloy (B) free from boron is shown in Table 1.

(Cooling and Solidifying Step)

The crucibles were taken out of a furnace and when the temperature of each molten alloy became 700° C., each molten alloy was poured into a mold. It took about 2 to 3 minutes until each molten alloy was cooled to 700° C. and poured into the mold. Each molten alloy was cast first into a sand mold for temperature measurement and then into a permanent mold according to JIS H5203 which has been preheated within the temperature range between 150 and 250° C.

Figure 1A:
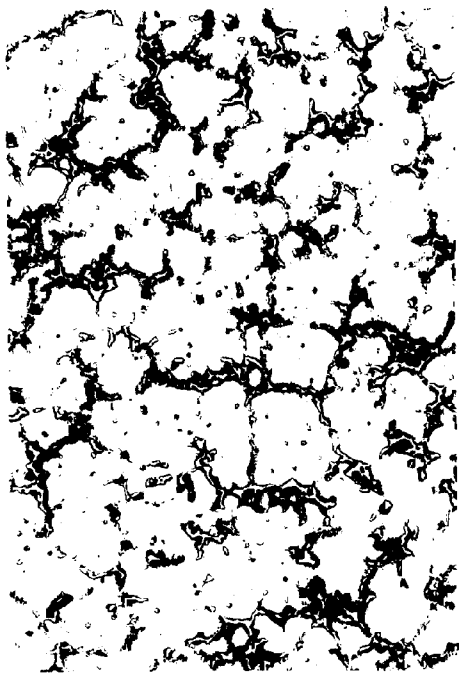
FIG. 1A is a photograph showing the microstructure of an as-cast magnesium alloy according to a first preferred embodiment of the present invention.
Figure 1B:
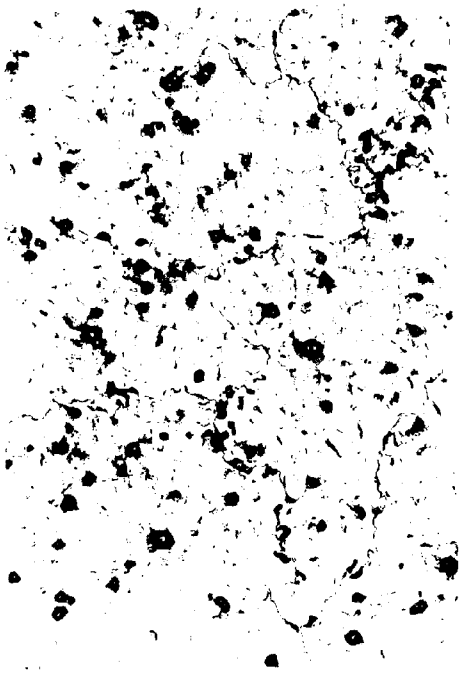
FIG. 1B is a photograph showing the microstructure of an as-cast magnesium alloy of a comparative example to the first preferred embodiment of the present invention.

Each permanent mold casting thus produced was cut at the longitudinal center and its microstructure was observed. FIGS. 1A and 1B are optical micrographs of the respective alloys as cast.

Figure 2A:
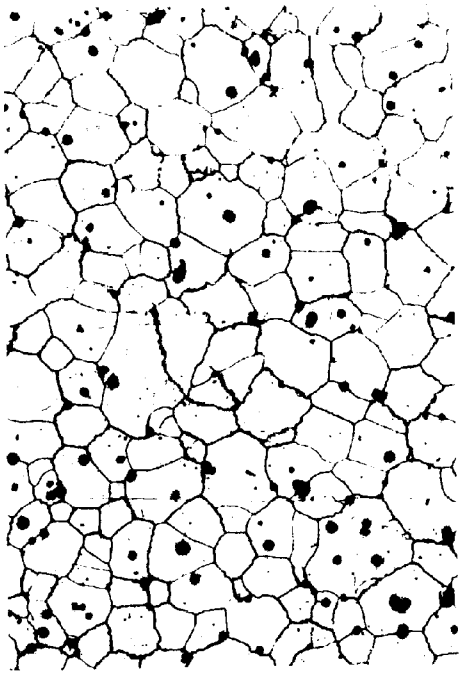
FIG. 2A is a photograph showing the microstructure of the specimen shown in FIG. 1A after being solution treated.
Figure 2B:
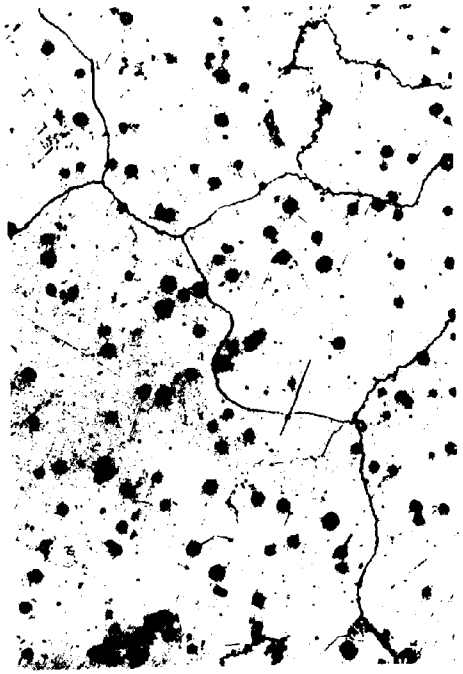
FIG. 2B is a photograph showing the microstructure of the specimen shown in FIG. 1B after being solution treated.

After solution treatment (415° C. for 24 hours in an argon gas atmosphere) was applied to each casting, the microstructure of each specimen was also observed. FIGS. 2A and 2B are optical micrographs of respective specimens.

The AZ91 alloy (B) free from boron had a large grain diameter of about 300 μm, as shown in FIG. 2B. However, the AZ91 alloy (A) containing boron had a small grain diameter of about 70 μm. Thus, it was confirmed that the addition of boron could attain remarkable grain refinement.

Figure 3:
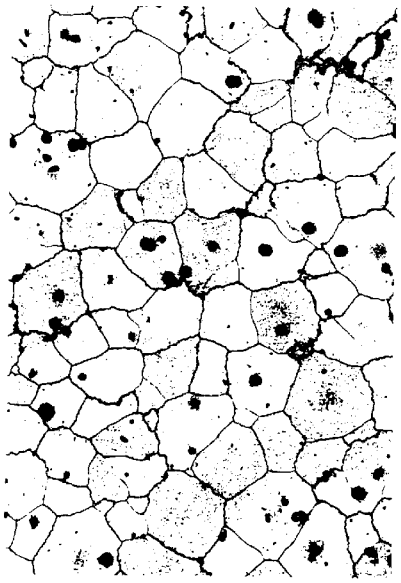
FIG. 3 is a photograph showing the microstructure of the magnesium alloy according to the first preferred embodiment of the present invention after being held quietly in molten state for 30 minutes and cast and solution treated.

Another specimen was prepared by employing the aforementioned boron-containing AZ91 alloy (A) and holding it quietly for thirty minutes in molten state and casting it into a mold. FIG. 3 shows the microstructure of this specimen after being solution treated (415° C. for 24 hours in an argon gas atmosphere). As apparent from this figure, it was confirmed that even the specimen after held quietly for 30 minutes maintained a sufficient grain refining effect.

Figure 4:
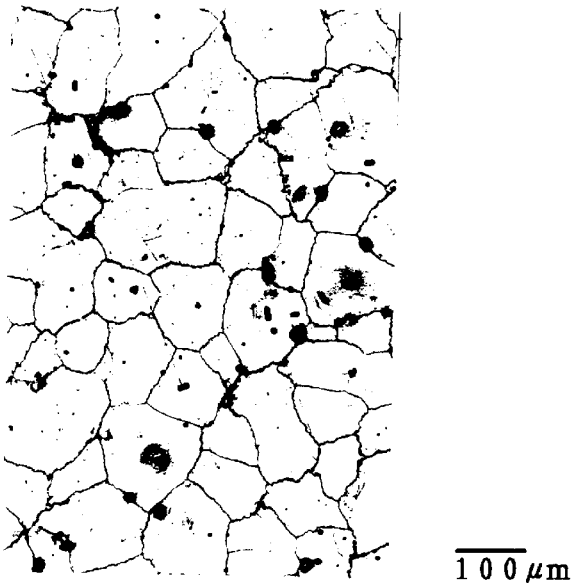
FIG. 4 is a photograph showing the microstructure of the magnesium alloy according to the first preferred embodiment after being remelted and cast and solution treated.

Still another specimen was prepared by remelting the aforementioned boron-containing AZ91 alloy (A) and carrying out similar casting. FIG. 4 is a photograph showing the microstructure of this specimen after being solution treated (415° C. for 24 hours in an argon gas atmosphere). This photograph demonstrates that even the remelted specimen could have small grain, that is, could maintain a grain refining effect.

Figure 5A:
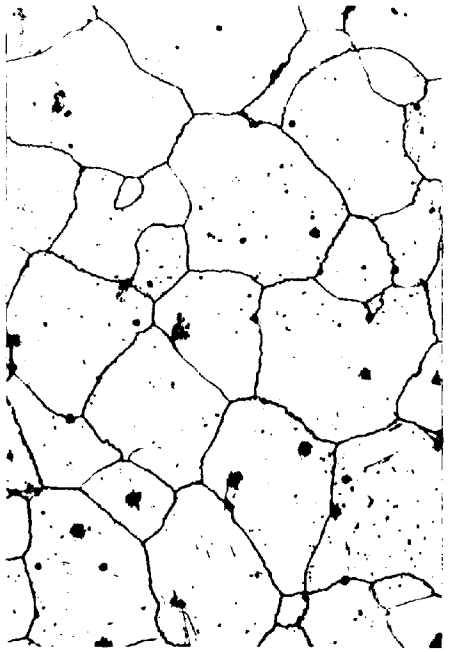
FIG. 5A is a photograph showing the microstructure of the alloy of added 0.05% boron according to the first preferred embodiment of the present invention and being solution treated.
Figure 5B:
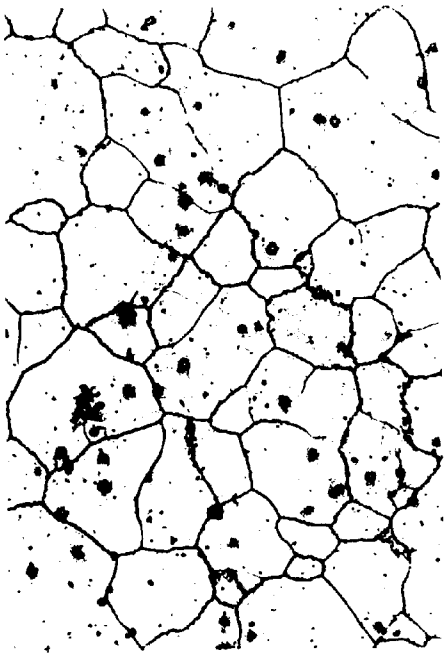
FIG. 5B is a photograph showing the microstructure of the alloy of added 0.1% boron according to the first preferred embodiment of the present invention and being solution treated.
Figure 5C:
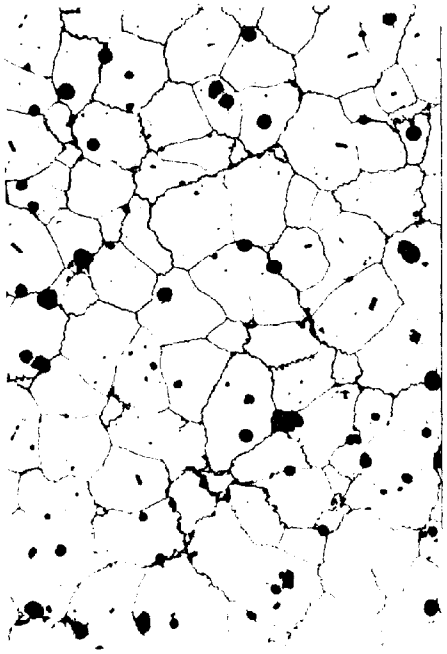
FIG. 5C is a photograph showing the microstructure of the alloy of added 0.2% boron according to the first preferred embodiment of the present invention and being solution treated.

Still other specimens were prepared by changing the nominal boron content of the aforementioned boron-containing AZ91 alloy. FIGS. 5A, 5B and 5C show optical micrographs of these specimens after being solution treated (415° C. for 24 hours in an argon gas atmosphere). As the nominal boron content was larger (FIG. 5A: 0.05%, FIG. 5B: 0.1%, FIG. 5C: 0.2%), the grain refining effect was more remarkable.

TABLE 1

| ALLOY | Al | Zn | Mn | B | Fe | Ni | Cu | Mg |
|---|---|---|---|---|---|---|---|---|
| Example (A) | 8.77 | 1.08 | 0.18 | 0.0030 | 0.014 | 0.002 | 0.002 | Bal |
| Comp. Ex. (B) | 8.85 | 1.01 | 0.37 | — | 0.022 | 0.001 | 0.001 | Bal |

Second Preferred Embodiment

In this preferred embodiment, magnesium alloys were prepared in a similar way to the magnesium alloy (A) according to the first preferred embodiment by making the nominal composition comprise aluminum of 9 weight %, zinc of 1 weight % and boron of 0.3 weight % and changing the manganese content variously. The raw materials, preparation method, casting conditions and the like were the same as in the first preferred embodiment. Nine specimens having different manganese contents were thus obtained.

Then, solution treatment (415° C. for 24 hours in an argon atmosphere) was applied to the respective cast specimens. The resultant specimens were cut at their longitudinal center and their microstructures were observed in a similar way to the first preferred embodiment.

Table 2 shows the composition and grain diameter of each specimen.

TABLE 2

| ANALYZED CHEMICAL COMPOSITION (weight %) | | | | | | GRAIN DIAMETER |
|---|---|---|---|---|---|---|
| Al | Zn | Mn | Fe | B | Mg | (μm) |
| 8.55 | 0.97 | <0.01 | 0.009 | 0.0053 | bal. | 227 |
| 8.54 | 1.01 | 0.02 | 0.008 | 0.0058 | bal. | 181 |
| 8.50 | 1.02 | 0.05 | 0.009 | 0.0023 | bal. | 98 |
| 8.49 | 0.96 | 0.09 | 0.010 | 0.0014 | bal. | 55 |
| 8.56 | 1.06 | 0.20 | 0.016 | 0.0014 | bal. | 52 |
| 8.51 | 1.02 | 0.27 | 0.012 | 0.0011 | bal. | 77 |
| 8.63 | 1.04 | 0.45 | 0.014 | 0.0015 | bal. | 81 |
| 8.52 | 1.04 | 0.90 | 0.010 | 0.0004 | bal. | 185 |
| 8.30 | 0.98 | 1.04 | 0.002 | 0.0002 | bal. | 198 |

Third Preferred Embodiment

In this preferred embodiment, zinc, which was added in the second preferred embodiment, was not contained and pure magnesium containing little iron was used as a raw material. The nominal boron content was set at 0.2 weight % and the nominal aluminum content was set at 8 weight %. The manganese content was varied, thereby preparing seven kinds of magnesium alloys. Other conditions than these were similar to those of the first and second preferred embodiments. Then the microstructures of these specimens were observed. Table 3 shows the composition and grain diameter of these specimens.

Specimens which were not subjected to the grain refining treatment had a grain diameter of 230 μm in the second preferred embodiment and 190 μm in the third preferred embodiment. It is apparent from the second and third preferred embodiments that when 0.03 to 1 weight % manganese was contained along with boron in a molten magnesium alloy, the grain diameter was decreased by 25% or more with respect to the specimens which were not subjected to the grain refining treatment and this is effective in refining the grain of magnesium alloys.

Particularly when manganese of 0.05 to 0.8 weight % was contained along with boron, the grain refining effect was very remarkable.

TABLE 3

| ANALYZED CHEMICAL COMPOSITION (weight %) | | | | | GRAIN DIAMETER |
|---|---|---|---|---|---|
| Al | Mn | Fe | B | Mg | (μm) |
| 7.63 | <0.01 | 0.002 | 0.0038 | bal. | 190 |
| 7.58 | 0.02 | 0.002 | 0.0034 | bal. | 151 |
| 7.54 | 0.10 | 0.003 | 0.0023 | bal. | 68 |
| 7.58 | 0.16 | 0.003 | 0.0018 | bal. | 52 |
| 7.60 | 0.52 | 0.003 | 0.0011 | bal. | 60 |
| 7.55 | 0.80 | 0.003 | 0.0010 | bal. | 99 |
| 7.50 | 1.06 | 0.003 | 0.0004 | bal. | 145 |

Fourth Preferred Embodiment

In this preferred embodiment, magnesium alloys were prepared by employing two kinds of Al-4% B alloys, an Al-4% B alloy including $AlB_2$ and $\beta$-$AlB_{12}$, and an Al-4% B alloy including $\alpha$-$AlB_{12}$. The nominal composition of the specimens of this preferred embodiment comprised aluminum of 9 weight %, zinc of 1 weight %, manganese of 0.5 weight %, and boron of 0.38 weight %. Other conditions than these were similar to those of the other preferred embodiments. Then, casting was carried out under the same conditions as in the first preferred embodiment. After solution treatment (410° C. for 24 hours and then forced-air quenching) was applied to the cast specimens, the microstructures of the respective specimens were observed.

Figure 6A:
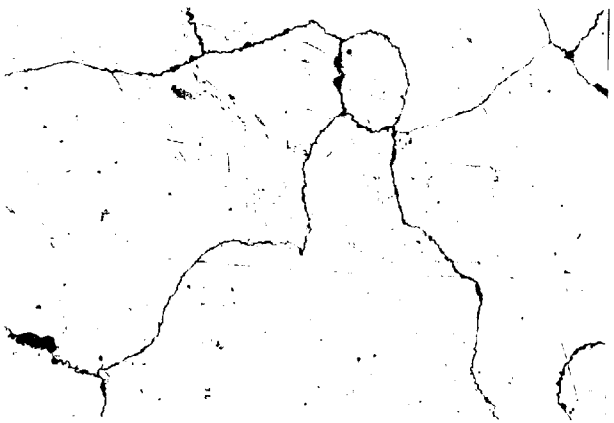
FIG. 6A is a photograph showing the microstructure of a specimen according to the fourth preferred embodiment of the present invention, which was prepared by using a Al-4% B alloy containing $\alpha$-$AlB_{12}$ and being solution treated.
Figure 6B:
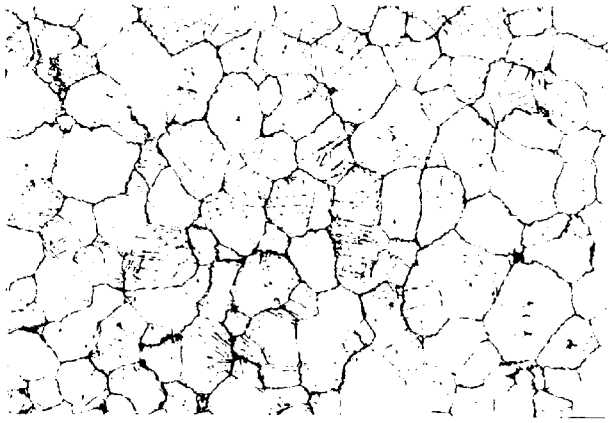
FIG. 6B is a photograph showing the microstructure of a specimen according to the fourth preferred embodiment of the present invention, which was prepared by using a Al-4% B alloy containing $AlB_2$ and $\beta$-$AlB_{12}$ and being solution treated.

Table 4 shows the composition and grain diameter of the respective specimens. Photographs showing the microstructure of the specimens are shown in FIGS. 6A and 6B. FIG. 6A is a photograph showing the microstructure of the specimen including $\alpha$-$AlB_{12}$ and FIG. 6B is a photograph showing the microstructure of the specimen including $AlB_2$ and $\beta$-$AlB_{12}$.

It is apparent from these photographs that grain refinement of the magnesium alloy was remarkable when boron was contained by using the aluminum-boron alloy (Al-4% B alloy)including $AlB_2$ and $\beta$-$AlB_{12}$.

On the other hand, it is clear that the aluminum-boron alloy including $\alpha$-$AlB_{12}$ only had a small effect of refining the grain of the magnesium alloy. This is supposed that $\alpha$-$AlB_{12}$ was stable in the molten magnesium alloy and therefore boron, which contributes to grain refinement, couldn't dissolve into themolten alloy.

TABLE 4

| COMPOUND IN Al-4% B | ANALYZED COMPOSITION OF A CASTING (wt %) | | | | | | GRAIN DIAMET- |
|---|---|---|---|---|---|---|---|
| ALLOY | Al | Zn | Mn | Fe | B | Mg | ER ($\mu$m) |
| $\alpha$-$AlB_{12}$ | 8.77 | 1.06 | 0.12 | 0.010 | 0.0001 | bal. | 367 |
| $\beta$-$AlB_{12}$ + $AlB_2$ | 8.59 | 1.00 | 0.18 | 0.015 | 0.0040 | bal. | 61 |

Obviously, many modification and variations of the present invention are possible in the light of the above teachings. It is therefore to be understood that within the scope of the appended claims, the invention may be practiced otherwise than as specifically described.

What is claimed is:

1. A magnesium alloy, consisting essentially of:

magnesium as a main component;

0.001 to 0.004 weight % of boron;

0.05 to 0.8 weight % of manganese; and substantially no zirconium and no titanium;

wherein said magnesium alloy has a grain diameter of 100 $\mu$m or less.

2. The magnesium alloy according to claim 1, further consisting essentially of 1 to 30 weight % of aluminum.

3. The magnesium alloy according to claim 2, wherein said aluminum is contained at 5 weight % or more.

4. The magnesium alloy according to claim 1, further consisting essentially of 0.1 to 20 weight % of zinc.

5. The magnesium alloy according to claim 1, further consisting essentially of 0.5 to 20 weight % of a rare earth element.

6. The magnesium alloy according to claim 1, wherein said alloy has a tensile strength of about 300 MPa.

7. The magnesium alloy according to claim 1, wherein said boron is contained at 0.001 to 0.0023 weight %.

8. The magnesium alloy of claim 1, having a tensile strength of 300 MPa.

9. A magnesium alloy, consisting essentially of:

magnesium as a main component;

0.001 to 0.0023 weight % of boron;

0.05 to 0.8 weight % of manganese; and substantially no zirconium and no titanium;

wherein said magnesium alloy has a grain diameter of 100 $\mu$m or less.

10. A method of producing a magnesium alloy, comprising:

(a) preparing a molten magnesium alloy consisting essentially of 0.001 to 0.004 wt. % boron, 0.05 to 0.8 wt. % manganese, and substantially no zirconium and no titanium by employing a grain refiner which includes at least one selected from the group consisting of metallic boron, a boron-containing compound and a boron-containing alloy, and at least one selected from the group consisting of metal manganese, a manganese-containing compound and a manganese-containing alloy, independently to each other or as a composite;

(b) cooling and solidifying said molten magnesium alloy to form magnesium alloy has a grain diameter of 100 $\mu$m or less.

11. The method of producing a magnesium alloy according to claim 10, wherein said boron-containing compound is at least one selected from the group consisting of aluminum boride, magnesium boride, boron oxide, and fluoroborate.

12. The method of producing a magnesium alloy according to claim 11, wherein said aluminum boride is $AlB_2$ and/or $\beta$-$AlB_{12}$.

13. The method of producing a magnesium alloy according to claim 10, wherein said boron-containing alloy is an aluminum-boron alloy.

14. The method of producing a magnesium alloy according to claim 10, wherein said manganese-containing compound is at least one selected from the group consisting of manganese boride, manganese fluoride and manganese hydroxide.

15. The method of producing a magnesium alloy according to claim 10, wherein said manganese-containing alloy is at least one selected from the group consisting of an aluminum-manganese alloy, a magnesium-manganese alloy and a zinc-manganese alloy.

16. The method of producing a magnesium alloy according to claim 10, wherein, in said molten metal preparation step, said grain refiner is added to said molten magnesium alloy.

17. The method of producing a magnesium alloy according to claim 10, wherein, in said molten metal preparation step, a raw material comprising said magnesium alloy and said grain refiner is heated to be melted.

18. The method of producing a magnesium alloy according to claim 10, wherein said cooling and solidifying step has at least one step selected from the group consisting of die casting, low pressure die casting, gravity casting, unidirectional solidification processing, continuous casting and pressure die casting.

* * * * *